United States Patent [19]

Schaeffer et al.

[11] 4,452,876

[45] Jun. 5, 1984

[54] STEAM, WATER OR HEAT DEVELOPING DIAZOTYPE MATERIAL

[76] Inventors: Andre Schaeffer, 71 Avenue Albert ler, 92500 Rueil; Antoine Wagner, 89 Chemin de Pre-Bron, 73000 Chambery, both of France

[21] Appl. No.: 265,085

[22] Filed: May 19, 1981

[30] Foreign Application Priority Data

Nov. 28, 1979 [FR] France ..... 79 29241

[51] Int. Cl.[3] ..... G03C 1/60

[52] U.S. Cl. ..... 430/162; 430/151; 430/155; 430/157; 430/176; 430/177; 430/178; 430/179

[58] Field of Search ..... 430/151, 162, 155, 157, 430/176, 177, 178, 179

[56] References Cited

U.S. PATENT DOCUMENTS

| | | | |
|---|---|---|---|
| 2,228,562 | 1/1941 | Dieterle | 430/151 |
| 3,284,201 | 11/1966 | Meijs et al. | 430/151 |
| 3,294,534 | 12/1966 | Halperin | 430/151 |
| 3,318,699 | 5/1967 | Lind | 430/151 |
| 3,353,984 | 11/1967 | Landau | 430/156 |
| 3,416,924 | 12/1968 | Tummers | 430/151 |
| 3,453,112 | 7/1969 | Schaeffer | 430/177 |
| 3,642,483 | 2/1972 | Kubo et al. | 430/151 |
| 4,130,426 | 12/1978 | Takeda et al. | 430/151 |

FOREIGN PATENT DOCUMENTS

| | | | |
|---|---|---|---|
| Ad.78679 | 7/1962 | France | 430/151 |
| 1379066 | 10/1964 | France | 430/151 |
| 53-30322 | 3/1978 | Japan | 430/151 |
| 1070625 | 6/1967 | United Kingdom . | |
| 1127237 | 9/1968 | United Kingdom | 430/151 |
| 2007861 | 5/1979 | United Kingdom | 430/151 |
| 2071126 | 9/1981 | United Kingdom | 430/151 |

OTHER PUBLICATIONS

Kosar, J., "Light-Sensitive Systems", J. Wiley & Sons, 1965, pp. 259-267.

Dinaburg, M. S., "Photosensitive Diazo Cpds", *The Focal Press,* 1964, pp. 120-124.

J. Weiner et al., "The Institute of Paper Chemistry-Diazotype Papers", *Biblio Series #220, 1965, pp. 119, 122, 123, 128-132 and 135.*

Kosar, J., *Photo. Sci. & Eng.,* vol. 5, No. 4, 1961, pp. 239-243.

*Primary Examiner*—Charles L. Bowers, Jr.

[57] ABSTRACT

The invention concerns a heat, steam or water developing diazotype material, containing a photosensitive diazonium salt stabilized with a non-diffusing acid and also one or several developing coats—which could contain the coupling agent—located on the front or back side of the used base material, products avoiding the interpenetration of the active agents, preventing the washing of one coat through the another during coating process, slowing down the absorption of ambient humidity at normal temperature, absorbing the volatile alkaline products at normal temperature, separating the essential reagents to avoid their spontaneous reaction, releasing an accelerating plasticizer during the development, reducing the activation temperature, improving the development by formation of an insoluble salt with the stabilizing acid, releasing a non-volatile weak acid in case of an attack by moisture. All these factors give stable products before use, developing with water in "dry" heliographic machines, or also with water in "semi-dry" machines, either by an appropriate adjustment of said machines or by addition of an adaptable system.

18 Claims, No Drawings

STEAM, WATER OR HEAT DEVELOPING DIAZOTYPE MATERIAL

Heat developing heliographic products are known. They give excellent results but present four disadvantages:

(1) They need a special machine for thermal development.

(2) They don't entirely solve the resulting pollution problem because some ammonia smell (formed during the thermal development remains.

(3) Their stability before use is lower than that of normal diazo products because of their tendency to form spontaneously the azoic dyes usually produced only during thermal development.

(4) Some of them curl inside or even roll a short time after development owing to absorption of humidity through the chemicals necessary for thermal development.

One of the objects of this invention is the provision of diazo papers, lacquered papers and films which can be used in thermal machines and also in "dry" and "semi-dry" machines.

In the case of ammonia machines, the ammonia solution will be replaced with water.

In the case of semi-dry machines the developer will be replaced with water or simply eliminated if the machine has a drying section. In this case, the development will be purely thermal.

Some "dry" machines will not be able to develop the above mentioned products, particularly if the heating of their developing section is well below 80° C. or if they do not have the usually used ammonia vaporization system; this system is necessary to vaporize water in the case of the use of products in accordance with the invention.

Another object of the invention is to offer simple systems, adaptable on each of these machines, which allow vapor development.

Another object of the invention is to eliminate any ammonia or amine smell during the thermal process. This elimination is obtained—among other things—by the use of alkaline-earth hydroxides of volatile acids as alkaline agents of the developing system. These products have the property that they react when heated—through their OH group—with the ammonium or amine salts releasing a base and at the same time releasing a weak acid capable of recombining when cold with excess of base, forming an odorless salt.

Another object of the invention is to provide heat, vapour or water developing diazotype products with much greater stability before use than the known thermal developing papers.

Another object of the invention is the provision of vapour or water thermal developing diazotype products which don't experience unacceptable concave "curl".

Another object of the invention is the realisation of water, vapour or thermal developing coats which give to the finished product a shiny surface.

The expression "vapour developing" must be understood in its broadest meaning. For example, some of the suggested products need only be dampened on their sensitive side: the absorbed water quantity is sufficient so that during the drying phase at ambient temperature the desired azoic dye is formed with an excellent yield.

Under these conditions the development reaction will take 10 to 15 minutes. It will be speeded up of course if, after treating the sheet with water, it is dried as in so called "semi-dry" machines. In this case the development will take only a few seconds.

The thermal developing diazotype products we know today act with chemicals contained in the back side of the photosensitive coat with respect to the base material. The thermal development takes place at 110° C., requires about 10 seconds and produces ammonia. This gas passes through the base material and forms the azoic dye in the coat located on the front side of the base material. Consequently this gas must be captured and retained in the developing section of the machine in order not to escape and so reduce the developing capacity. In fact, the free air heating of such sheets causes the formation of only a very small quantity of dye, because the ammonia escapes before it has time to sufficiently increase the PH of the sensitive coat to produce the desired dye.

Therefore it is easy to understand that such a product is not fit for the purpose of the present invention which is to provide diazotype products developing in machines that are intended for use in other developing systems.

In other words the products of the invention must completely develop at 80° C.–90° C. in the presence of humidity without the necessity of close contact between the base material and the heating source.

This is an absolutely necessary condition and an essential difference between the known thermal products and the present invention.

The reaction leading to the desired result are carried out by the action of temperature, or humidity, or both acting together on a plurality of chemicals contained in one or several layers.

The development principle consisting of causing an ammonium or amine salt to react with an alkaline salt which releases ammonia or amine is well known.

Such a system can be represented with the following equation:

$$(NH_4)_2SO_4+Na_2CO_3 \rightarrow Na_2SO_4+CO_2+H_2O+2NH_3$$

The ammonia and water generated develop the azoic image. Amine salts can also be used.

The object of the invention is to obtain stable diazotype products before use and, using the above principle, to obtain the above mentioned development.

The following lists the factors which have a dominant influence on obtaining products according the invention:

(1) The disposition of the reactive layers.

(2) The presence, nature and disposition of the products preventing the interpenetration of the layers.

(3) The presence of substances preventing the washing of the diazonium salt through the aqueous overlayers.

(4) The presence of acid salts, or inclusion compounds of acids, capable at ambient temperature of absorbing humidity and gradually produced bases, which react to form a stable salt which can in turn be released during development.

(5) The use of symmetrical or asymmetrical salts of ethylene diamine, diethylene triamine, triethylene tetramine, or hexamethylene diamine which combine with some ammonium or amine salts to give mixes with reduced melting point and result in a better contactless development due to their reduced volatility.

(6) The use, as stabilizing products of the light sensitive layer, of acids incapable of migrating into the adjacent layers.

(7) The use of back coats slowing which slow down the humidity penetration through the base backside and absorb any existing alkalinity.

(8) The separation of the reactive products by inert pigments.

(9) The presence in the external layer of a hydrophobic wax which melts at the developing temperature or of a wax mixture containing such wax.

(10) The use, as developing accelerator, of plasticizers that are liquid at the developing temperature and are employed as solid inclusion compounds, the plasticizer being released only during development.

(11) The partial use of semi-oxide, semi-salts of alkaline earth derivatives as alkaline developing and deodorizing agents.

(12) The use of volatile weak-acid salts which react during development with the strong stabilisation acid of the photosensitive coat, forming a precipitate and releasing a volatile weak acid which absorbs the residual smell.

(13) The use of the coupler in a layer other than the one containing the diazonium salt. The interaction of these products to produce the azoic dye will take place only during the developing phase. Thus, one increases considerably the stability of the system before use.

From now on all these conditions will be called "the list".

Good products according the invention are generally obtained if at least six of these factors are used correctly and simultaneously. The following explanations will allow a better understanding of the principles needed for the practice of the invention.

(1) As a points 1, 2, 3 and 5 of the above mentioned list:

(1-1)—The reaction system includes at least two products (one alkaline salt and one ammonium and/or amine salt) and is coated in one coat, both products being used in powdered pigment form together with an organic binder, one binder per pigment.

The binders will be chosen so as not to be miscible (to ensure the separation of the reagents) but must give at the same time a non-floculated homogeneous final dispersion. This last condition is essential, as any floculation penetrates the organic liquid (and the remaining dissolved binder) in the adjacent coat, which reduces the developing speed.

Example 1 describes such a binder system.

In this example the non-miscible binders are represented by Movilith 20 (Hoescht) and Dinotal (Dyno Inustrier S.A. Norway).

Other mixtures of such type are for example:

SAIB (Kodak) and Dercolyte S 85 (Chevassus)
Movilith 20 and Uralac 36480.
Solpolac 300 (Cafaro) and Ethylcellulose 100 (Hercules)
Rhodopas M (Rhone Poulenc) and Ethylcellulose 100
Movilith 50 and Dercolyte S 85
Uralac 45 and Ethylcellulose 100
Uralac and Paraloid B 66 (Rohm and Hass)
Rhodopas M and Paraloid A T 10
Solpolac 10 and Uralac 45
Movilith 20 and Alphtalat V AC/20/30 (Hoescht)
Dercolyte S 85 and Dynomin/UN 90 (Dyno).

The different described examples show the use of some mixtures of this type. The photosensitive layer on which this mixture is coated will contain repulsive products stopping any penetration of the organic liquid, in the reactive layer. Such penetration would carry binder into the lower layer and would actually slow down considerably, during the development, the neutralisation reaction of the acid in this latter.

This repulsing effect is obtained in Examples 1 and 2 by the high concentration of the salts used in the photosensitive layer. Said salts establish an absolute barrier against the solvent penetration of the second layer, this being one of the features of the invention.

The products called "repulsive" will be composed of neutral mineral salts, soluble enough to be used in such a concentration that they avoid the wetting of the layer enclosing them, by the organic liquid of the overlayer.

Such products are, for example, the alkaline and alkaline earth halides, some stable ammonium salts such as $NH_4Br$, $NH_4Cl$, i.e. incapable of spontaneously releasing ammonia. Their concentration can be up to 50% of the used water.

Besides these products some binders can help in this action.

We can mention:

Methylcelluloses
Carboxymethylcellulose
Polyvinylpyrrolidone
Polyvinylic alcohols
Sodium and ammonium polyacrylates
Natural gums, etc.

(1.2)—In the case where the developing system is coated in two layers over the photosensitive layer, the first one can be aqueous. In this case the repulsive agent could be the ammonium or amine salt (or both) used for the development.

The aqueous layer will possibly contain a product such as a thiocyanate that precipitates the diazonium salt of the photosensitive layer and thus prevents it from being "washed".

The coating and drying of this coat gives then no problem. It is described in Example No. 3.

The first developing layer consists of an aqueous solution of ammonium sulfamate. The ammonium sulfocyanide helps to stop any dissolution of the diazonium salt of the underlayer as it precipitates it in an absolutely insoluble form. The role of the monoammonium phosphate will be specified later on as will the role of the ethylene diamine monochlorhydrate, monoformate.

The second developing layer consists essentially of a dispersion of sodium bicarbonate in toluene. This dispersion is obtained by grinding by one of the known means such as a ball mill, said mill, or vertical ball mill.

One also adds a binder to fix the organic layer to on the first developing layer.

During the steam development, for example the ammonium sulfamate, the ethylene diamine monochlorhydrate monoformate and the monoammonium phosphate dissolve and react with the sodium bicarbonate, producing ammonia and ethylene diamine. These two bases neutralize the acid sulfate of the photosensitive layer, which neutrilization causes the formation of the dye between the diazonium salt and the coupler used.

(1.3)—The reaction system is coated in one or two coats on the back of a paper base.

These two cases are similar to the presently used thermal developing papers. As we specified, these products cannot be used in other machines than thermal developing machines because, if the developer is not built to prevent any ammonia leak, the development does not take place because the gas escapes before formation of the image occurs.

It seems therefore advisable to use amine salts instead of ammonium salts with the hope that their lower volatility will eliminate the above inconvenience. In fact, aside from the fact that such salts are very hygroscopic which obviously does not allow their use for stability reasons, the produced amines diffuse too slowly through the base material, because of their molecular weight, to be of any practical use.

But it has been found that the lighter diamine, the ethylene diamine, is perfectly adapted to the invention's needs.

This diamine forms many salts with strong acids. These salts are stable in that: they release no base even during lengthy storage. They are not hydroscopic. Particularly interesting are some asymmetrical stalts, not described in the literature, and therefore also claimed as new products. Obviously these products can also be used in layers coated on the front side of the diazotype product.

Generally the melting point of these substances is higher than desired but it has been found that almost all of them produce eutectics with some ammonium salts of strong acids. One results in mixtures melting at about 100° C., which is more than sufficient for the pursued purpose, that is, to release the ethylene diamine during a thermal reaction. This base diffuses easily through the base material and develops the azoic image on the other side without the necessity of any gas stopping system. Such a product will also develop in thermal machines and in the drying section of semi-dry machines, which current thermal papers can not do.

The vapour development is still possible, but is slower than that resulting from layers located over the photosensitive layer.

If such system is coated in one layer, the ethylene diamine salt and the ammonium salt will be milled together with a binder and an organic liquid. The alkaline salt will be treated in the same way. The whole mix will be coated on the back or front of a sensitized paper base.

If the system is coated in two layers, the first will be an aqueous layer containing the salt in solution. It will contain as well a solution of the additive allowing to obtain a reduced melting point. After coating and drying the second layer will be coated. It contains the alkaline salt in suspension in an organic liquid together with a binder, a wax and a developing accelerator.

This is described in Example 4.

The ethylene diamine salts usable for the invention are for example the following:

| | |
|---|---|
| (1) ethylene diamine dihydrochlorate | sublim.: 300° |
| (2) ethylene diamine dibromhydrate | F: 350° |
| (3) ethylene diamine dinitrate | F: 180° |
| (4) neutral oxalate | F: 155° |

The new asymmetrical salts of ethylene diamine are for example the following:

| | |
|---|---|
| (5) monoformiate monochlorohydrate of ethylene diamine | F: 260° |
| (6) monoacetate monochlorohydrate of ethylene diamine | F: 260° |
| (7) monoacetate monosulfamate | F: 150° |

-continued

| | |
|---|---|
| of ethylene diamine | |
| (8) monoformiate monosulfamate of ethylene diamine | F: 163° |
| (9) monopropionate monochlorhydrate of ethylene diamine | F: 260° |
| (10) monocaproate monochlorhydrate of ethylene diamine | F: 230° |
| (11) monoacetate mononitrate of ethylene diamine | F: 173° |

The reduction of the melting point obtained from the use of some of these products is as follows:

| | |
|---|---|
| Product No 1: + 50% ammonium sulfamate | F: 190° |
| Product No 3: + 50% ammonium sulfamate | F: 115° |
| Product No 4: + 50% ammonium sulfamate | F: 70° |
| Product No 8: + 50% ammonium sulfamate | F: 110° |
| Product No 3: + 50% ammonium nitrate | F: 100° |
| Product No 4: + 50% ammonium nitrate | F: 90° |
| Product No 7: + 25% ammonium sulfamate | F: 120° |
| Product No 7: + 50% ammonium sulfamate | F: 82° |
| Product No 7: + 50% monoammonium phosphate | F: 190° |
| Product No 7: + 25% monoammonium phosphate + 25% ammonium sulfamate | F: 120° |
| Product No 6: + 25% ammonium sulfamate | F: 120° |
| Product No 6: + 25% ammonium nitrate | F: 95° |
| Product No 6: + 25% ammonium nitrate + 25% ammonium chloride | F: 65° |
| Product No 6: + 25% ammonium chloride | F: 100° |
| Product No 10: + 25% ammonium sulfamate | F: 105° |
| Product No 10: + 75% ammonium sulfamate | F: 100° |
| Product No 10: + 25% ammonium thiocyanate | F: 115° |

In the case where the active systems are coated over the photosensitive layer it is no longer necessary that the released amine diffuses through the base material. In this case, salts of heavier polyamines can be used such as those of hexamethylene diamine, diethylene triamine, triethylene tetramine, etc.

We can mention among others:

| | |
|---|---|
| (12) Hexamethylene diamine disulfamate | F: 162° |
| (13) Hexamethylene diamine sulfamate, formiate | F: 155° |
| (14) Diethylene triamine sulfamate, formiate | |
| (15) Triethylene tetramine disulfamate, formiate | |
| (16) Triethylene tetramine sulfamate, chlorhydrate | |
| (17) Diethylethylene diamine sulfamate, chlorhydrate | |
| (18) Dimethylethylene diamine sulfamate, chlorhydrate | |
| (19) Trimethylene diamine sulfamate, chlorhydrate | |

The six last products were not isolated but used in solution. All these products give also mixtures with a reduced melting point. For example:

| | |
|---|---|
| Product No 13: + 25% ammonium sulfamate | F: 125° |
| Product No 13: + 50% ammonium sulfamate | F: 122° |
| Product No 13: + 25% ammonium nitrate | F: 65° |
| Product No 13: + 10% ammonium nitrate 25% $PO_4H_2NH_4$ | F: 100° |
| Product No 12: + 25% ammonium nitrate | F: 100° |
| Product No 12: + 25% ammonium sulfocyanate | F: 110° |

All the above mentioned salts are prepared in the same way: successive neutralisation of the base until PH 6 by acids in water at the highest possible concentration, cooling and precipitation with alcohol or acetone of necessary. Filtration, washing with acetone, drying.

(1.4)—The external layer of the developing system-on the front or back side of a diazotype product-includes a wax as waterproofing agent against exterior humidity.

It was found that many waxes are well adapted to the invention's needs. They are waterproof at room temperature but melt during the development and for this reason do not harm the developing reactions.

These waxes are more or less soluble in the organic liquids used or, if not, they are easily dispersed in them.

All examples describe the use of these waxes.

As usable waxes we will mention:

Mobilwax or Waxrex (Mobil)
Oxazoline waxes (IMC Chemie)
paraffin waxes
Carnauba wax
animal wax
Ceresine wax
EL 90 wax
beeswax
Candelia wax
ester waxes (Glycochemical)
Acrawax (Glycochemical)

This list is not at all exhaustive. Of course wax mixture can be used. It is desirable that at least one of these waxes is fusible at the desired temperature of development.

Example 8 mentions such a mixture. One will notice that this example describes the realization of a lacquered paper for thermal development. A secondary purpose of the described mixt, is to endow the finished product with an increased brightness, which is a desirable characteristic of lacquered papers.

(1.5)—The percoat—which is similar to the layers used for the production of "dry" papers in the sense that it contains a pigment and a film-forming binder dispersed or dissolved in water, and that it is coated on the base paper before the photosensitive layer-can also contain a barrier product against organic solvents or a waterproofing agent and thus contributes to reduce the atmospheric humidity absorption by the back side of the base paper.

This is described in Example 3.

(1.6)—Further to the above paragraphs one will deduce that the product according invention can be composed of up to five layers which are:

Precoat (aqueous)
Phososensitive layer (aqueous)
Backing layer (aqueous, anti-curl)
First thermosensitive layer (aqueous, on the front)
Second thermosensitive layer (organic solvent, on the front)

Very few machines are able to produce in one operation such a sequence of layers.

However one can—and it is one of the invention's features-combine the first two layers in one, provided the system is so formulated that the products of the first layer are not washed away by the second coating.

Example 7 discloses how to do that.

In the example the washing away of diazonium salt is avoided. Sodium thiocyanate of the next layer precipitates it in a particularly insoluble form.

(2) As to points 4, 6, 7, 8 and 9:

The stability increase of the whole system is obtained with various measures which act on the causes of instability of thermal developing diazotype products.

The invention does not concern phenomens such as bad drying of the aqueous layers. However it is recommended to dry to less than 3% water.

It is also recommended to apply all of the layers in one operation in order to avoid any intermediate humidity absorption.

On the other hand, the invention provides a series of means capable of stopping the action of humidity on the sensitive sheet when the package is opened, and also capable of reducing such an actin in the case where the manufacturing standards are not strictly followed.

The humidity action on light-sensitive thermal material is easy to understand.

Most of the active chemicals used are soluble in water. Some are hygroscopic. If humidity is absorbed by the system, partial solubilisation takes place, diffusion of the products occurs, leading to reactions producing alkaline and volatile substances and finally to spontaneous formation of dyes.

Such a process takes place during storage if the diazotype products were dried. It also takes place after the opening of the packages at the time of use.

The following means are suggested to increase the stability:

(2.1)—The aqueous back layer includes also a rather strong and non-volatile acid and a silicone-base emulsion. The acid concentration will be 1 to 5%. The silicone emulsion concentration will be 0.5 to 2%.

The role of the acid is to fix any volatile base that could be formed on the preceding sheet side in the package. The role of the silicone emulsion is to stop humidity diffusion by the back, through the base material, to the front side when the sheet remains out of the package before use.

The usable non-volatile acids are for example tartric acid, sulfamic, citric, oxalic, etc. . . .

Such a protection is described in Example 1.

(2.2)—The reaction products are better separated by use of a certain concentration of inert pigments. Such pigments are for example silicon oxides, kaolin, talc, chalks, calcites, dolomites, calcium carbonate, barium carbonate, etc. . . . The concentrations can vary from 20 to 100% of the active product. These separating agents can be used if the system is coated in two layers or in one layer.

Example 3 describes a layer containing such an agent (calcium sulfate).

(2.3)—The solubilisation and migration of the stabilisation acid under the influence of the humidity of the photosensitive layer is reduced by using acids with higher molecular weight.

Such acids are for example:

N-hexylsulfamic acid
Hexylamine acid sulfate
Hexamethylene diamine acid disulfate
Hexamethylene diamine acid maleate, acid sulfate
Hexamethylene diamine diacid phosphate, acid sulphate
Laurylamine acid sulfate
Diethylene triamine acid disulfate
Triethylene tetramine acid disulfate As a result of their molecular shape, these products cannot leave their layer and migrate into the layer containing the alkaline salts and neutralize it, a process which is one reason for the short shelf life of some thermosensitive products.

(2.4)—One layer, or the other, or both layers of the reaction system contain one or several salts capable of absorbing at ambient temperature the humidity and/or the ammonia or the amine that could be formed under the influence of this humidity, giving thus a new salt stable at ambient temperature but decomposable between 80° and 100° C. i.e. during development releasing thus the products it had fixed.

Such substances are for example monoammonium phosphate, monosodium phosphate, the monopotassium phosphate, etc...

Example 5 specifies the use of monosodium phosphate milled with ammonium nitrate.

This product reacts only very little with nitrate and this at too high a temperature to be of any interest in steam developing systems.

On the other hand, at normal temperature, it absorbs well the water of the ambient humidity and the ammonia that can be formed and gives monoammonium monosodium phosphate: $PO_4HNaNH_4$, $4H_2O$.

This product is perfectly stable at normal temperature and decomposes at its melting point (98° ), during development, and gives back the ammonia and the water it has absorbed:

$$2PO_4HNaNH_4, 4H_2O \rightarrow P_2O_4H_2Na_2 + 2NH_3 + 5H_2O$$

In that way we obtain a better stability of the sheet in humid air (before use) without reduction of the developing capacity.

Examples 3 and 4 specify for the same purpose the use of monoammonium phosphate in a layer containing other salts.

Salts with a certain absorption capacity for humidity and volatile bases, but without the same restitution facility can also be used.

Such are for example: $BeCl_2$, $BeSO_4$, LiCl, $ZnCl_2$, LiF, and also the alkaline monotartrates and the monooxalates.

Another way to use this principle is to employ inclusion compounds of the urea/organic acid type in pigment form.

Under the action of the humidity the inclusion compound is destroyed and the acid is released. As the action of humidity leads as well to the formation of a base, this last is at least partly fixed by the acid, giving a salt. During heat development, this salt is hydrolysed and releases its base. The urea/sebacic acid inclusion compound of Example 7 is used for this purpose.

(2.5)—In the case where the developing system contains salts of amines or polyamines one can add—to increase the stability—products capable of producing at room temperature, stable inclusion compounds with amines (and therefore capable of fixing them if they are formed during storage), but capable of releasing them under the influence of warm humidity.

Such products are for example:

tetrachlorobisphenol A (Monsanto)
tetrabromobisphenol A (Dow)
hexachlorophene (Sindar)
bithionol (Actamer) (Monsanto)
bisphenol A (Dow)
4,4'-thiobis(6-t-butyl m-cresol) (Monsanto)
2,2'-methylene bis(4-methyl-6-t-butylphenol) (American cyanamid)

Example 1 describes the use of such a product.

(3) Point 10 of the list deserves particular attention.

It has been noticed that some liquid plasticizers increase considerably the developing speed of thermal or steam developing papers, increase their developing capacity without direct contact, and reduce the veil effect given by some pigments.

Simultaneously they unfortunately greatly reduce the shelf life of the diazotype products. The reason is certainly that liquid pasticizers act as partial solvents of the binders used and, as "vehicles", favour the contact between the chemicals, producing thus spontaneous coupling reactions. It was therefore indicated to shield these plasticizers until development.

A marked improvement of the stability is obtained if the plasticizer is dispersed in the precoat or in the sensitizing layer but a one superior technique is the following one:

It is known that some inclusion compounds of the urea/plastisizer type have been industrially used for twenty years in adhesive systems initiated by heat at the melting point of the urea the internal compound (plasticizer) is released for the adhesion action.

Some urea/plasticizer or thiourea/plasticizer are compositions particularly adapted to our products. These are stable solids easy to mill. The water or vapour action dissolves urea or thiourea and releases the product contained in the crystal lattice. Thus, the development is speeded up. Before development the plasticizer, shielded in a solid crystal lattice, exerts no influence on the stability of the product.

Experience shows that only plasticizers with a linear structure enter into the urea cristal. This, even if it reduces the number of possibilities, allows still a huge choice of products because all alcohols, esters, or cetones of more than 8 carbon atoms can be used.

Thus, the developing accelerators active only during the development are urea and thiourea inclusion compounds containing as a guest esters or alcohols or polyalcohols having more than 8 carbon atoms, the crystal structure of the urea or thiourea being destroyed during the development and the guest set free to act as a coupling accelerator.

The preparation of these products is extremely simple. One uses a urea solution in 20% warm methanol and adds the plasticizer (5 g for 25 g of urea approx.).

Generally, the product precipitates from the hot solution.

One allows the product to cool down, filters i.e., washes with methanol and dries it with air.

Generally, the mentioned products include 8 to 10 mols urea/mol. of plasticizer.

A quick test of the product consists in adding warm water to the obtained crystals: urea or thiourea dissolve. An oily liquid forms at the surface: it is the plasticizer.

The following inclusion compounds have been found particularly interesting:

(1) Urea/butyl stearate
(2) Urea/ethyl oleate
(3) Urea/dodecanol
(4) Urea/diotyl adipate
(5) Urea/dibutyl sebacate
(6) Urea/oleic acid
(7) Urea/stearic acid
(8) Urea/ethoxylated nonyl phenol
(9) Urea/propylene glycol distearate
(10) Urea/ethylene glycol dipalmitate
(11) Urea/glycerine monooleate
(12) Urea/hexyl maleate
(13) Urea/butyl glycol stearate
(14) Urea/ethylene glycol stearate
(15) Urea/diethylene glycol stearate
(16) Urea/diethylene glycol oleate
(17) Urea/ethyl palmitate
(18) Urea/cetyl palmitate

(19) Urea/diethyladipate
(20) Thiourea/triethyleneglycol dibenzoate
(21) Thiourea/tetradecylcyclohexane
(22) Thiourea/1-5 dicyclohexylpentane
(23) Thiourea/1-4 dicyclohexylbutane
(24) Thiourea/n-amylcyclohexane
(25) Thiourea/polyethyleneglycol 8000
(26) Thiourea/polyethyleneoxyde
(27) Thiourea/polyethyleneglycol 4000
(28) Thiourea/citronellyl isovalerianate
(29) Thiourea/laurylamide These products are used in the pigment form milled as usual in an organic liquid at a 50% concentration. One adds the suspension to the organic dispersion used anyway for the developing layer, a quantity of 20% by in volume representing a good average.

Examples No 1, 3, 5 and 8 describe the use of these products.

We should point out that some of these substances are easily prepared by direct milling in toluene without the necessity of isolating them.

(4) Point 11 of the list concerns the use of agents reducing the smell during and after development.

This smell is in any case very slight. No smell at all can be noticed in the vapour development.

The smell during development in the thermal machines is also practically non-existent. The problem of semi-dry machines remains.

In this case one wets the paper with water and then dries, or one heats the product in free air. If there is formation of an excess of base this latter diffuses in the atmosphere. To minimize this disadvantage it is advisable to release at the same time a weak acid that fixes the excess base.

It has been found that some new developing agents, the semi-hydroxides of alkaline earths fulfil this condition.

These hydroxides have the general formula:

HO—Me—OCOR

| | |
|---|---|
| Me | = alkaline earth (Ca, Sr, Ba) |
| R | = H |
| | = $(CH_2)_n CH_3$ with n = 1 to 4 |
| | = $CH_2OH$ |
| | = $CHOHCH_3$ |

These products mixed with appropriate ammonium (or amine) salts give thermal reactions of following type:

$$HOCaOCO{-}CH_3 + NH_4X \longrightarrow HOCaX + CH_3COONH_4 \text{ (X = anion of the salt)} \quad (1)$$

$$HOCaX + NH_4X \longrightarrow CaX_2 + NH_3 + H_2O \quad (2)$$

At this stage the diazotype product develops.

Then the ammonium acetate is dissociated (under hot conditions):

$$CH_3COONH_4 \rightarrow CH_3COOH + NH_3$$

This diazotype product finishes developing. An $NH_3$ excess may remain, which when cold, at the exit of the machine, will recombine with the acetic acid.

$$NH_3 + CH_3COOH \rightarrow CH_3COONH_4$$

Thus, the smell is eliminated or very greatly reduced.

Some of the mentioned semi-hydroxides are described in the literature. Others were heretofore unknown.

Their preparation is very simple and follows the reaction scheme:

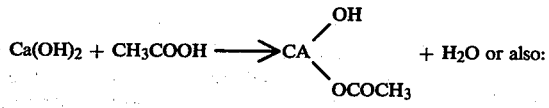

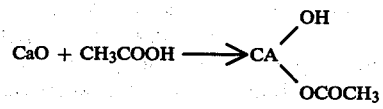

One prepares a toluene suspension, with stirring, of the oxide or alkaline earth hydroxide in question at a concentration of 21 g for 500 $cm^3$ approx.

One adds 1 mol. acid over a few minutes so to regulate the very exothermic reaction. There is no detriment in allowing the temperature to increase to 70° C. approx.

As soon as the acid smell has disappeared, which takes a few minutes to one hour, one filters, mixes with acetone, filters, dries at about 100° C. or in the free air.

The yield is about 80 to 100%.

None of the products has a melting point below 260° C. in the anhydrons form.

It has been noticed that some of the mentioned products can be prepared starting from hydroxide and an acid anhydride according the reaction:

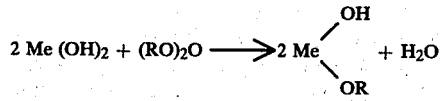

In this case it has been noticed that the sometimes very slow initiation of the reaction can be catalyzed by addition of several drops of water.

The non-restricting following list gives the composition of some products which answer the purposes of the invention:

HO—Ca—OCOH: calcium monohydroxide monoformiate
HO—Ca—$OCOCH_3$: calcium Monohydroxide monoacetate
HO—Ca—$OCOC_2H_5$: calcium monohydroxide monopropionate
HO—Ca—$OCOCH_2OH$: calcium monohydroxide monoglycolate
HO—Sr—OCOH: strontium monohydroxide monoformiate
HO—Sr—OCOCH: stontium monohydroxide monoacetate
HO—Sr—OCOCHOH $CH_3$: strontium monohydroxide monolactate
HO—Ba—OCOH: barium monohydroxide monoformiate
HO—Ba—OCO $(CH_2)_4$ $CH_3$: barium monohydroxide mococaproate Example 5 describes a layer containing one of these products.

(5) Point 12 also is of great interest. It makes use of an insolubilisation reaction of the stabilisation acid to contribute on the one hand to the development of the diazotype product, on the other hand to reduce the smells of the volatile bases.

If for example the stabilisation acid of the photosensitive layer is an acid sulfate, an acid phosphate, or oxalic acid and if in one of the other layers one uses as a part of the system an alkaline earth salt of a volatile acid, then, one obtains by the action of water or steam, the formation of an insoluble salt, of a volatile acid and possibly of a base. For example if stabilisation acid is ethylene diamine acid sulfate and the alkaline earth salt is calcium acetate, we will have following reaction:

$$(SO_4H_2)_2NH_2CH_2CH_2HN_2 + 2(ACO)_2Ca \xrightarrow{H_2O}$$

$$(ACOH)_2NH_2CH_2CH_2NH_2 + 2ACOH + CaSO_4\downarrow$$

Part of the acetic acid can be released to fix any possibly present volatile base and so eliminate its smell.

Part of it will be neutralised by the alkaline developing agent e.g. $KHCO_3$ and will give potassium acetate, which is also a developing agent:

$$CH_3CooH + KHCO_3 \rightarrow CH_3COOK + CO_2H_2O$$

The ethylene diamine acetate will be also split into in potassium acetate and ethylene diamine, which are both developing agents:

$$(ACOH)_2NH_2CH_2CH_2NH_2 + 2KHCO_3 \rightarrow 2CO_2 + 2ACOK + 2H_2O + NH_2CH_2CH_2NH_2$$

However is must be well understood that this method only asssists the development but is not a sufficiently efficient developing system if used alone.

Example 7 includes this improvement.

The usable salts for this purpose are the formiates, acetates, and propionates of calcium, strontium, barium, zinc, aluminum and magnesium.

(6) Point 13 is very significant because it allows a greater production flexibility and brings about a distinct increase of the shelf life of the thermal systems used.

As shown in Example 7, a high concentration (40%) of ethylene diamine disulfamate is used in the photosensitive layer. This layer does not contain any coupler. This latter is used in the top, in pigment form, in which there is also the alkaline salt.

The usable couplers for this technique of the invention are for example:

2-3-diaxynaphthalene 2-oxy-3 morpholinopropylenenaphthoic acid aceto acetanilide 2-4, 2'-4' tetrahydroxydiphenyl sulfide the ethanolamide of alpharesorcylic acid etc. . . .

These couplers allow all desired colour combinations.

(7) We also mentioned previously the problem of the inside curl of the thermo developable products.

This extremely undesirable condition is due to the air humidity absorption by the chemicals of the back layer: the base material expands and the sheet curves after a period that can vary between a few minutes and some weeks. This phenomenon is eliminated in the case of vapour developing paper and this for two reasons:

(1) The quantity of chemicals used is much smaller as these products are in a layer in direct contact with the sensitive layer.

(2) All things being equal, the products being on the front side, the curl is slightly convex, which is acceptable.

(8) The invention suggests finally some improvements to the "dry" developing machines, so to make all them capable of treating the suggested "vapour" products.

The "dry" machines usually have a pump which moves the ammonia solution into a container, the "boiler", which is heated by a themostatically regulated resistance, where the ammonia is released from its solution and wherein it diffuses into the developing section which is also provided with electrical resistances and a thermostat.

In the case of "vapour" papers, the ammonia solution is simply replaced with water.

If the development turns out to be insufficient, one only needs to adjust the thermostat of the "boiler" at a higher temperature and (or) to do the same for the heating resistances of the developing section. If necessary one can add one or several resistances.

Another way consists in preheating the water before its entry into the "boiler", with the help of a submerged resistance for example.

The following examples will make clearer the use of the various explained principles.

EXAMPLE 1

On the paper base for diazotype products one coats first a precoat of the usual type for "dry" papers.

Then one coats a back layer composed of an aqueous solution of 3% oxalic acid and of a 1% dispersion of silicone resin "Rhodorsil 240" from Rhone-Poulenc (Waterproofing agent).

One coats then the following photosensitive solution:

| | |
|---|---|
| Water 70° | 80 L |
| Ammonium chloride } top layer repelling agents | 10 Kg |
| Sodium chloride } top layer repelling agents | 10 L |
| Solution at 40% of ethylediamine acid sulfate (1) (non diffusing stabilising acid) | 10 L |
| Thiourea | 4 Kg |
| 4-morphilino-2,5-diethoxybenzenediazonium chlorosincate | 1.5 Kg |
| 3-hydroxynaphthalene-2-carboxylic acid morpholinopropylamide | 1.2 Kg |
| Zinc chloride | 3 Kg |
| Formic acid | 7 L |

The solution (1) is prepared from a solution of diluted sulphuric acid and 0.5 mole of ethylene diamine.

One coats and dries the photosensitive layer. Next one prepares a dispersion of sodium bicarbonate (100 Kg) milled in 150 L toluene in a manner known per se, so as to obtain particles smaller than 10 microns.

One adds to this dispersion one volume of a first binder: a 50% Movilith 20 (Hoechst) solution in toluene. One also prepares a second dispersion composed of 100 kg ammonium sulfamate and 20 Kg of ethylene diamine/sulfamate milled in 150 L toluene with 30 kg of calcium sulfate in a well-known way, so to obtain particles smaller than 10 microns. One adds to this dispersion 0.5 volume of Dynotal 03 XB and mixes it with the first one. These two binders are not miscible. Then one adds 20% of a 20% suspension of EL 90 Wax (Mobil) in toluene (fusible wax). One finally adds the premilled dispersion:

5 Kg tetrachlorobisphenol A (stabilizer)
10 Kg toluene

This mixture is coated over the photosensitive layer and dried with warm air at 70° C. in 3–4 seconds. One coats 6 to 15 g products per $m^2$.

The obtained heliographic product develops as usually in thermal machines of the "Chapel" type (Chambery-France)

It also develops with vapour in "dry" machines in which ammonia is replaced with water whose flow will be equal to the flow of ammonia normally used. The temperature in the developing chamber will be 80°–100°.

This example uses the following principles of the list: 1-2-5-6-7-8-9.

EXAMPLE 2

In the photosensitive solution of Example 1 one replaces the ethylene diamine acid sulfate by the same quantity of hexamethylene diamine acid sulfate.

The external layer is constituted as follows:

One mills in a well-known way 100 Kg of ammonium sulfamate and 50 Kg calcium carbonate (separation pigment). Then one adds 30 Kg binder "Solpolac 300" (Cafaro-Milano). One also mills 100 Kg potassium carbonate in 100 L toluene and then adds 30 Kg of a 20% dispersion of "Mobilwax 31 U" (fusible wax) in toluene. One finally mills 10 Kg of the inclusion compound: Urea/Dodecanol (shielded plasticizer) in 30 Kg toluene and one adds 1 Kg of Goodyear's Pliolite AC (binder).

These three dispersions are mixed and coated over the photosensitive layer as already explained.

The obtained product shows a quicker vapour development than that obtained in Example 1.

This example uses the following principles of the list: 1-2-5-6-7-8-9-10.

EXAMPLE 3

Ones coats first a precoat of the normally used for type the "dry" diazotype papers, to which is added 20–40% of glascol $HA_2$ (Allied Colloids) as an agent for restraining the humidity absorption through the back of the paper.

Over this precoat one coats the sensitive layer of Example 1, but without $NH_4Cl$. Then ones coats over the photosensitive layer an aqueous solution containing:

| | |
|---|---|
| (1) Ammonium sulfamate: | 30% by weight |
| (2) Ethylene diamine monoformate, monochlorhydrate: | 15% |
| (3) Monoammonium phosphate: | 10% |
| (4) Ammonium thiocyanate: | 0.5% |

In this solution:

(2) helps to reduce the melting point of (1)

(3) is an ammonia absorber under cold conditions, used to increase stability.

(4) eliminates the washing away of the diazonium salt of the lower layer.

Then one coats the back layer of Example 1.

One finally coats following overlayer:

| | | |
|---|---|---|
| One mills: | Sodium diacid phosphate: | 30 Kg (Ammonia absorber under cold conditions) |
| | Sodium bicarbonate: | 10 Kg (Developing agent) |
| | Calcium acetate: | 10 Kg (Anti-smell and stabilizing acid precipitating agent) |

in 150 L toluene so as to obtain grains of less than 10 microns.

Then one adds the binders:

Ethylcellulose N 100: 2 Kg (Hercules)

Paraffin wax (melting point 70°): 15 Kg

One homogenizes the whole and coats over the previous layer, drying at 50°–60°.

The obtained diazotype product develops under the same conditions as the product of Example 1. If one treats this product in a "semi-dry" type machine in which the developer is replaced by water containing some moistening agent one also obtains a blue image.

This example uses the following principles of the list: 1-2-3-4-5-6-7-9-12.

EXAMPLE 4

One coats at first a precoat of the standard type. Then one coats the sensitizing layer of Example 3. Then one coats a first aqueous back layer constituted as follows:

| | |
|---|---|
| (1) Ethylenediamine monoacetate monosulfamate | 60% by weight/volume |
| (2) Ammonium nitrate | 25% by weight/volume |
| (3) Monoammonium phosphate | 15% by weight/volume |

In this mixture (1) helps to decrease the melting point of the mixture. Moreover the ethylenediamine produced during the development reduces the necessity of a perfect seal during the thermal or vapour treatment.

(3) is a stabilisation agent which absorbs ammonia that could be formed under cold conditions under the influence of the humidity.

One finally coats the second back layer:

One mills 90 Kg of potassium bicarbonate and 10 Kg of sodium monophosphate in 150 L toluene till one obtains grains smaller than 10 microns.

One mills in 20 L toluene, 5 Kg of the inclusion compound Urea/dibutylsebacate in order to obtain grains smaller than 10 microns and adds this dispersion to the previous one.

Then one adds 10 Kg Movilith M 50 and 15 Kg Wawrex 2370 (Mobil) wax and homogenizes the whole.

This layer is coated as second back layer and dried.

The development of the finished product takes place as already explained.

This example uses the following principles of the list: 1-4-5-6-9-10.

EXAMPLE 5

On a precoat used for the "dry" products one coats the photosensitive solution of Example 1 and also the same back layer. Then one prepares the following dispersion milled to less than 10 microns:

50 Kg ammonium nitrate
20 Kg hexamethylene diamine monoformiate monosulfate
30 Kg monosodium phosphate
2 Kg Inipol 002 (Prochinor-Paris) (wetting agent)
2 Kg Alcreftal 1098×50 (binder) from Ashland Chemical
8 Kg Movilith H 60 (binder)
150 L toluene One prepares a second dispersion:
70 Kg calcium monohydroxide monoformate
30 Kg potassium bicarbonate
2 Kg Inipol 002
20 Kg paraffine wax (melting point circa 70°)
2 Kg Elwax 210 (Dupont) (binder)
One also mills: 5 Kg inclusion compound thiourea/triethyleneglycol dibenzoate.
:15 Kg toluene.

One mixes the three dispersions and coats the whole over the photosensitive layer, in the usual way. The finished product develops as normally.

This example uses the following principles of the list: 1-2-4-5-6-7-8-9-10 11-12.

EXAMPLE 6

One coats to start with the precoat of Example 3.

Then on this precoat, one coats a photosensitive solution prepared according to Example 1 in which the ammonium and sodium chloride are replaced by 25 Kg of ammonium sulfamate and 10 Kg ethylene diamine sulfamate and the coupler eliminated.

Then one applies the back layer of Example 1.

The following dispersion is then prepared and milled to less than 10 microns:
100 Kg sodium bicarbonate
10 Kg 3-hydrooxynaphthalene-2-carboxylic acid-morpholinopropylamide
10 Kg Solpolac 300 (binder)
15 Kg Oxazoline OWR-170 (wax)
150 Kg toluene
A second dispersion is prepared:
10 Kg inclusion compound urea/ethoxylated nonylephenol
20 L toluene
0.5 L Inipol 002
3 Kg Uralac 45 (binder)
2 Kg Alprodur CP 646 (binder) from Hoechst.

Both dispersions are mixed and coated over the photosensitive solution in the already described way.

The finished product develops as already specified.

This example uses the following principles of the list: 1-2-5-6-7-9-10-13.

EXAMPLE 7

One prepares a "one shot" precoat and sensitizing composition so that the whole can be coated in one process:

| | |
|---|---|
| Water 70°: | 80 L |
| Citric acid: | 2 Kg |
| Hexylamine acid sulfate 40%: | 5 L |
| Thiourea: | 4 Kg |
| Zinc chloride: | 3 Kg |
| Formic acid: | 7 L |
| Diazonium salt of Example 1: | 2.2 Kg |
| 2-3 dihydroxy - 6-sulfonaphtalene: | 1 Kg |
| 2-4, 2'-4' tetrahydroxydiphenyl sulphide: | 0.2 Kg |
| Then one disperses in this solution: | |
| Syloid 72 (pigment from Grorce Co): | 3 Kg |

This mixture is coated as usual.

Normally such a formula powders i.e. loses its pigment by rubbing in the developing machines, as the pigment is not fixed by a binder.

In the present case this tendency is not significant, because one superposes two other coats over the first one.

The second coat will be constituted as follows:

| | |
|---|---|
| Water: | 100 L |
| Ammonium sulfamate: | 50 Kg |
| Hexamethylene diamine formate, sulfamate: | 20 Kg |
| Sodium thiocyanate: | 0.5 Kg |

This layer is coated and dried as already specified.

The back layer will be for example that of Example 1.

Then the third coat is prepared.

One mills as already explained 70 Kg sodium bicarbonate, 20 Kg sodium monophosphate and 10 Kg calcium acetate in 150 L toluene.

Then one adds:
15 Kg Solpolac 10 (binder)
5 Kg Waxrex 31 U (Wax from Mobil)
3 Kg Alphtalat V AC (binder) from Hoescht
One mills also:
5 Kg of inclusion compound urea/sebacic acid in 10 Kg toluene, adds 2 Kg resin Aroplaz 2466 (binder) from Archer Daniels and then adds this mixture to the dispersion.
One coats and dries as usual.

The development of this product gives a black image.

This example uses the following principles of the list: 1-3-4-5-6-7-8-9-12-13.

EXAMPLE 8: LACQUERED PAPER

On a base paper of the lacquered type, one coats a sensitized laquered coat constituted as follows:

| | |
|---|---|
| Ethanol: | 65 L |
| Cellulose acetopropionate C A P 504 - O2 (Kodak): | 5 Kg |
| One stirs to dissolve and adds: | |
| Water: | 16 L |
| Formic acid: | 6 L |
| Diethylene triamine acid sulfate: | 0.4 Kg |
| Citric acid: | 0.4 Kg |
| Thiourea: | 0.8 Kg |
| Diazo of Example 1: | 0.6 Kg |
| 2-4, 2'-4' Tetrahydroxy diphenyl: | 0.4 Kg |
| Zinc chloride 60%: | 0.5 L |
| One applies circa 4g/m2 of dry layer. | |
| Then one coats the first overlayer: | |
| Water: | 75 L |
| Ammonium sulfamate: | 30 Kg |
| Ethylene diamine sulfamate: | 10 Kg |
| Movilith D M C2: | 25 L |

One coats at a dry weight of about 3 g/m2.

| | |
|---|---|
| One applies a back layer: | |
| Water: | 50 L |
| Ethanol: | 50 L |
| Citric acid: | 5 Kg |

Then one prepares the second top layer:

One mills 90 Kg $NaHCO_3$ and 10 Kg $NaH_2PO_4$ in 150 L toluene and one adds:

| | |
|---|---|
| Paraloid B 66 (binder from Rohm and Haas): | 3 Kg |
| Oxazolidine wax T X2: | 10 Kg |
| Lauric acid: | 3 Kg |
| Paraffin wax (melting point circa 80°): | 6 Kg |

One homogenizes the whole and then coats the dispersion over the first overlayer.

One applies about 4 g/m2 second overlayer.

The composition of the second overlayer gives a shiny surface to the finished product.

The development of the obtained lacquered paper is made as the development of the papers and gives a brown image.

This example uses the following principles of the list: 1-4-5-6-7-9.

Having now described our invention what we claim as new and desire to secure by Letters Patent is:

1. In a diazotype material developable at 80°–100° C. with humidity, comprising a support carrying a precoat and an overlying layer of:

(a) a light-sensitive two-component diazotype layer containing a light-sensitive diazo compound, a coupling component capable of coupling with said compound to form an azodyestuff and a stabilizing agent, and (b) a two-component developing system layer coated on the light-sensitive layer or on the backside of the support, one of the components being a heat stable ammonium or amine salt, the other being an alkali or alkaline earth metal salt;

the improvement in which the light-sensitive layer (a) comprises as stabilizing agent a non-migrating acid which is blocked by virtue of its molecular shape and cannot migrate in the developing layer upon storage and a two-component repulsive system preventing the penetration of the developing layer into the light-sensitive layer and lowering the melting point of the developing system, the developing layer (b) comprising waxes melting during the development and acting as agents to promote said development, binders for each said component of the developing system, and developing accelerators which are inclusion compounds retaining a plasticizer and becoming active only during development, the light-sensitive layer being coated in the form of an aqueous layer, and the uppermost developing layer being coated in the form of an organic solvent layer.

2. A diazotype material according to claim 1, wherein the developing layer further comprises an inert pigment allowing a better separation of the two components and thus a better action of humidity during development.

3. A diazotype material according to claim 2, wherein the inert pigment used to separate the components for higher stability prior use and better activity during the humidity action, are selected from the group consisting of the silicon oxides, kaolins, talc, chalks, calcites, dolomites, calcium or barium carbonates.

4. A diazotype material according to claim 1, wherein the developing layer further comprises developing aids which also act as smell hiding products.

5. A diazotype material according to claim 4, wherein the developing aids are used in the form of pigments selected from the group consisting of calcium, strontium and barium semihydroxides of formic, acetic, propionic, butyric, caproic, glycolic or lactic acids, the latter substances being able to act simultaneously as developing aids owing to their OH-group, and as ammonia smell hiding products owing to their volatile acid group.

6. A diazotype material according to claim 1, wherein the binders for each component of the developing system are non-miscible, one of them protecting the first component, the other protecting the second component but not leading to any flocculation of the dispersion.

7. A diazotype material according to claim 1, wherein the non-migrating acid stabilizing the light-sensitive layer against pre-coupling, is selected from the group consisting of sulfamic acid N-substituted by an aliphatic radical having at least 6 carbon atoms, and a polyacid monosalified by an amine or a diamine having 4 to 11 carbon atoms.

8. A diazotype material according to claim 1, wherein the waxes used as reaction vehicles when molten are selected from the group consisting of, oxazoline waxes, carnauba wax, paraffin waxes, beeswax, animal waxes, candelia wax, and ester waxes.

9. A diazotype material according to claim 1, wherein the developing accelerators active only during the development are urea and thiourea inclusion compounds containing as a guest esters or alcohols or polyalcohols having more than 8 carbon atoms, the crystal structure of the urea or thiourea being destroyed during the development and the guest set free to act as a coupling accelerator.

10. In a diazotype material developable at 80°–100° C. with humidity, comprising a support carrying a precoat and an overlaying layer of:

(a) a light-sensitive two-component diazotype layer containing a light-sensitive diazo compound, a coupling component capable of coupling with said compound to form an azo dyestuff and a stabilizing agent, and (b) a two-component developing system coated on the light-sensitive layer or on the backside of the support, one of the components of the developing system being a heat stable ammonium or amine salt, another being an alkali or alkaline earth metal salt;

the improvement in which the light-sensitive layer (a) comprises as stabilizing agent a non-migrating acid which is blocked by virtue of its molecular shape and cannot migrate in the developing layer upon storage, the two-component developing system (b) is coated in the form of two adjacent layers, the first layer including the first component of the two-component developing system and a two-component repulsive system preventing the penetration of the developing layers into the light-sensitive layer and lowering the melting point of the developing system and being deposited in the form of an aqueous layer over the light-sensitive layer, the second layer including the second component of the two-component developing system and being deposited in the form of an organic layer, the developing system (b) comprises waxes melting during the development and acting as agents to promote said development, binders for each component of the developing system, developing accelerators which are inclusion compounds retaining a plasticizer and become active only during development, the light-sensitive layer being coated in the form of an aqueous layer.

11. A diazotype material according to claim 10, wherein the developing layer further comprises an inert pigment allowing a better separation of the two components and thus a better action of humidity during development.

12. A diazotype material according to claim 11, wherein the inert pigment used to separate the components for higher stability prior use and better activity during the humidity action, is selected from the group consisting of silicon oxides, kaolins, talc, chalks, calcites, dolomites, calcium or barium carbonates.

13. A diazotype material according to claim 10, wherein the developing layer further comprises developing aids which also act as smell hiding products.

14. A diazotype material according to claim 13, wherein the developing aids are in the form of pigments selected from the group consisting of calcium, strontium and barium semihydroxides of formic, acetic, propionic, butyric, caproic, glycolic or lactic acids, said substances being able to act simultaneously as developing aids owing to their OH-group, and as ammonia-smell-hiding products owing to their volatile acid group.

15. A diazotype material according to claim 10, wherein the binders for each component of the developing system are non-miscible, one of them protecting the first component, the other protecting the second component but not leading to any flocculation of the dispersion.

16. A diazotype material according to claim 10, wherein the non-migrating acid stabilizing the light-sensitive layer against pre-coupling, is selected from the group consisting of sulfamic acid N-substituted by an aliphatic radical having at least 6 carbons atoms, and a polyacid monosalified by an amine or a diamine having 4 to 11 carbon atoms.

17. A diazotype material according to claim 10, wherein the waxes used as reaction vehicles when molten are selected from the group consisting of mobil-waxes, oxazoline waxes, carnauba wax, animal waxes, candelia wax, acrowax and ester waxes.

18. A diazotype material according to claim 10, wherein the developing accelerators active only during the development are represented by the class of the urea and thiourea inclusion compounds containing as a guest esters or alcohols or polyalcohols having more than 8 carbon atoms, the crystal structure of the urea or thiourea being destroyed during the development and the guest set free acting as a coupling accelerator.

* * * * *